United States Patent [19]

Carswell et al.

[11] 4,251,431

[45] Feb. 17, 1981

[54] LUBRICATING GREASES

[75] Inventors: William D. Carswell, Chester; Arthur Youd, Weaverham; Alexander C. B. MacPhail, Wirral, all of England

[73] Assignee: Shell Oil Company, Houston, Tex.

[21] Appl. No.: 3,826

[22] Filed: Jan. 16, 1979

[51] Int. Cl.[3] ..... C10M 3/46; C10M 3/24; C10M 3/14

[52] U.S. Cl. ..... 252/40.7; 252/49.6; 252/54; 252/389 R

[58] Field of Search ..... 252/49.6, 40.7, 54, 252/389 R

[56] References Cited

U.S. PATENT DOCUMENTS

| | | | |
|---|---|---|---|
| 3,011,975 | 12/1961 | Nitzsche et al. | 252/49.6 |
| 3,664,956 | 5/1972 | Messina et al. | 252/49.6 |
| 3,691,074 | 9/1972 | Messina et al. | 252/54 |
| 3,981,811 | 9/1976 | Zletz | 252/49.6 |

OTHER PUBLICATIONS

"Lubricant Additives" by Smalheer et al., 1967, The Lezius-Hiles Co., Cleveland, Ohio, p. 4.

*Primary Examiner*—Delbert E. Gantz
*Assistant Examiner*—Irving Vaughn

[57] ABSTRACT

An improved high-performance grease comprising a base fluid comprising a major amount of a linear perfluoroalkyl polyether fluid together with a minor amount of a methyl polysiloxane fluid and thickener is disclosed.

13 Claims, No Drawings

LUBRICATING GREASES

BACKGROUND OF THE INVENTION

The present invention relates to lubricating greases. In particular the invention relates to lubricating greases providing improved performance over a wide range of temperatures. Most especially it provides improved performance greases for use in the lubrication of high speed bearings.

Modern advances in technology and especially in the field of aerospace require that equipment be capable of operation over an ever increasing range of temperatures. For example, equipment installed in an aircraft may be expected to stand under Arctic conditions for a period of time and then to commence to operate immediately on demand. This same equipment may then be required during subsequent use to operate at running temperatures up to 200° C. For example, the efficient use of various machines, mechanisms and instruments in aircraft frequently calls for a degree of manipulative skill and consistent performance that cannot be directly achieved by human operators. Recourse is therefore made to automatic control systems, which are actuated by the difference between the actual behavior of the system and the desired behavior and into which some source of external power is introduced. Such so-called servo systems are therefore said to be error actuated and power amplifying. An important requirement is the accuracy of regulation or follow-up. This necessitates the use of closed loop sequence control and is effected by introducing a feed-back link between the output and input of the system. A servomotor is one form of element commonly included to provide the requisite precision and speed of response.

In the present context, a servomotor is a small two-phase a-c motor. One phase has constant excitation on the field coil and the other is fed from the error signal via an amplifier, which raises the power level to the point required by the motor. A servomotor has the characteristic of being reversible and its speed is proportional to the applied voltage. Thus, the corrective action of the servomotor is proportional to the error, i.e., to the divergence from the desired output of the servo system.

It follows that a servomotor is usually operating at well below maximum speed. Its speed only surges when a change is made in the input signal. As soon as the error signal has been corrected, the motor speed falls and the sermomotor operates in a low-speed hunting mode until a further change in the input signal is made.

Some servomotors are installed in the hot environment of engine bays, where typically, they are used to control throttle mechanisms and constant-speed drives. Thus, the bearings employed in these servomotors often operate as speeds up to and in excess of 6,000 revolutions per minute (r.p.m.). Greases for use in such bearings must have very low starting torques at low temperatures and yet have very good high temperature stability.

The greases of the present invention are intended primarily for use in bearings operating at speeds up to and in excess of 6,000 revolutions per minute (r.p.m.) at temperatures from 200° C. down to minus 54° C.

Under these conditions, a lifetime in excess of six months (4,320 hours) at 200° C. is considered desirable.

In order that a grease formulation should be considered for the present use, it is essential that it has good low-temperature properties and yet is stable to evaporation and oxidation at elevated temperatures and that it has a good storage or shelf life. In order to define the requirements more specifically, greases for consideration can be evaluated using the following suggested scheme.

(1) The grease should preferably be an NLGI Grade 2 grease. NLGI grading is that of the National Lubricating Grease Institute and the grades are defined as ranges of the 60 double stroke worked penetration at 25° C. as determined by the method of IP 50/69 ASTM D 127-68) "Cone Penetration of Lubricating Greases". An NLGI Grade 2 corresponds to an IP penetration at 25° C. between 265–295.

(2) The dropping point to the method of IP 132/65 (ASTM D.566-76) should preferably be in excess of 250° C.

(3) When examined under an optical microscope, there should be no large particles visible.

(4) When submitted to the Low Temperature Torque Test according to the method of IP 186/64 at minus 54° C. the starting torque should be less than 5,000 g.cm., and the running torque less than 2,000 g.cm.

(5) The high temperature stability may be examined using a Thin Film Oxidation Test at 200° C. where a film of grease 63.5 mm×35.0 mm×1.6 mm is smeared onto a mild steel strip 76.0 mm×51.0 mm×1.6 mm and maintained at 200° C. in an air oven for a minimum period of 72 hours. Appearance and weight loss are noted. Weight loss should be as low as possible.

(6) The storage life can be investigated by packing bearings, glass containers and/or tins with the grease and examining these during and after storage under relevant conditions. For the present purpose, the conditions were (a) ambient temperature, (b) 40° C., (c) 100° C., and (d) 200° C.

(7) Resistance to evaporation as investigated using the Evaporation Test according to the method of IP 183/63 at 200° C. modified to use a 1 mm layer of grease with both air and nitrogen flow. A very low percentage evaporation is required under all conditions.

Further evaluation of those greases which satisfy the above requirements is then carried out by actual use in typical bearings run under simulated use conditions. Suitable miniature ball bearings can be SR Z RHH 7P5 8LDZD bearings, 0.125 inch bore×0.375 inch o.d.×0.156 inch wide supplied by Miniature Precision Bearing Company. They are manufactured from stainless steel and are fitted with a ribbon container and metal shields on either side of the balls. These bearings can be housed in a suitable test rig and run under realistic conditions. For example, they can be driven by small servomotors of the type employed as described earlier and mounted within an oven regulated at some chosen temperature, for example 200° C. Failure occurs when the rig driving motor no longer rotates the bearing.

An alternative rig test procedure is Ministry of Defense method DEF-2000, Method 27, Procedure B, called the Pope Rig Test in which a test bearing is rotated under light radial and thrust loads at 10,000 revolutions per minute until either a specified time is reached or until failure occurs. Bearings normally used in this test are SAE 204 (8-ball 20 mm bore) fabricated from 18-4-1 high speed or M 10 tool steel, tempered for use up to 370° C., manufactured to ABEC 3 standards and having a radial clearance of 0.0010 to 0.0012 inch. Ball retainers are fabricated from heat treated silver plated beryllium copper capable of withstanding temperatures up to 370° C. We did not, however, employ the high quality, expensive bearings specified for this test in the present work but replaced them by SAE 204 (8-ball, 20 mm bore) fabricated from 52100 steel and reported to be heat treated to 177° C. These bearings have previously been found to give adequate service at 200° C. The bearings are manufactured to ABEC 3 standards and have a radial clearance of 0.0006 to 0.0010 inch. The balls are retained by a pressed steel cage. This rig test is best carried out with test conditions controlled on bearing temperature and not oven temperature. Failure occurs when motor power output increases to a value approximately 300% above that for steady running for a period greater than 30 seconds; when belt slippage occurs or when the bearing no longer rotates. Success in this test is an indication of the suitability of a grease for use in more normal size bearings as compared to the miniature ones employed in the previous rig test.

Extensive screening of prior art high performance greases, having a variety of base fluids and thickening systems using the above-suggested evaluation scheme, has shown none to have a lifetime greater than two months (1,500 hours) as well as satisfying the other requirements even when tested at a maximum temperature of only 175° C.

SUMMARY OF THE INVENTION

A novel improved high performance grease has now been formulated which has a lifetime in excess of eight months (6,000 hours) at a maximum temperature of 200° C. under the test conditions.

According to the present invention, an improved high performance grease comprises a base fluid comprising a major amount of a linear perfluoroalkyl polyether fluid together with a minor amount of a methyl polysiloxane fluid and a thickener. The novel grease of the present invention can be further improved in its performance by the addition of a highly basic mineral oil-free dispersant/anti-rust additive.

The following examples are given to illustrate the invention. In the examples given, the performance of the grease formulations of this invention and comparative lubricating compositions were tested according to the evaluation scheme listed earlier. All the formulations evaluated were selected as being examples of those considered or advertised as the most suitable for use under the test conditions.

EXAMPLES

EXAMPLE A

A grease was prepared from a mixture of monopentaerythrityl esters (Hercolube T) containing a commercial anti-oxidant package, thickened with polytetrafluoroethylene.

EXAMPLE B

A grease was prepared using the mixture of esters employed in Example A together with the same antioxidant package but thickened with a proofed clay-type thickener.

EXAMPLE C

A grease was prepared from a mixture of dipentaerythrityl esters (Hercolube F) containing a commercial antioxidant package, thickened with polytetrafluoroethylene.

EXAMPLE D

A grease was prepared using the mixture of esters employed in Example C together with the same antioxidant package but thickened with a proofed silica-type thickener.

EXAMPLE E

A grease was prepared using a mixture of complex neopentyl esters together with a commercial antioxidant package, thickened with polytetrafluoroethylene.

EXAMPLE F

A grease was prepared using the mixture of complex neopentyl esters employed in Example E together with the same antioxidant package but thickened with a proofed clay-type thickener.

EXAMPLE G

A grease was prepared from a mixture of basically linear perfluoroalkyl polyethers (Fomblin Y25), thickened with a proofed silica-type thickener.

EXAMPLE H

A commerically available grease prepared from a second mixture of linear perfluoroalkyl polyethers (Krytox 143) reported to have anarrower boiling range than those employed in Example G, thickened with polytetrafluoroethylene was obtained for this example.

EXAMPLE J

A grease was prepared using a synthetic hydrocarbon fluid together with a commercial antioxidant package, thickened with a proofed silica-type thickener.

EXAMPLE K

A commercially available grease prepared using a silicone fluid together with a commerical additive package, thickened with a fluorocarbon oligomer was obtained for this example.

EXAMPLE L

A commercially available fluorosilicone fluid based grease was obtained for this example.

EXAMPLE M

A grease was prepared using the mixture of linear perfluoroalkyl polyethers employed in Example H together with methylphenylsilicone fluid, and thickened with polytetrafluoroethylene.

EXAMPLE N

A grease was prepared similar to Example M but having added a highly basic mineral oil-free anti-rust additive.

RESULTS

The following table lists the results obtained when the various grease formulations of Examples A to N were submitted to the various tests listed:

TABLE 1

| Example | Thin Film Oxidation Test 72 hrs at 200° C. Loss % m | Appearance | Evaporation Test IP 183/63 48 hrs at 200° C. Air % m | N 2 % m | IP 186/64 L.T. Torque at −54° C. Start g. cm | Running g. cm | Micro bearing Rig Test Hours | Appearance | Pope Rig Test Hours |
|---|---|---|---|---|---|---|---|---|---|
| A | 9.4 | stiff paste | | | 3,800 | 2,300[b] 5,200[c] | | | |
| B | 56 | stiff paste | | | | | | | |
| C | 29.4 | stiff paste | | | 5,100 | 10,700[b] 7,800[c] | >1,000 | hard, thick brown cake lacquer, bearing rough | |
| D | 67.7 | brittle solid | 58.9 | 11.7 | | | 120 | hard brown lacquer, bearing noisy rough | |
| E | 45.7 | stiff paste | | | | | | | |
| F | 71.2 | stiff paste | | | | | | | |
| G | 44.9 | cracked but grease like | 44 | 44 | | | | | |
| H | 11 | grease | 5 | | 11,200 | 12,250[b] 5,600[c] | >6,000 | hard, cracked but still grease-like, bearing smooth | 4,432 |
| J | 66.9 | hard black solid | 34.8 | 35.3 | | | | | |
| K | 5.2 | grease | 4 | | 200 2,000 max | 500 max | 630 | rubbery paste, bearing rough | 500[d] |
| L | 17.6 | grease | 9.9 | | | | >1,000 | hard brittle lacquer some soft grease some white crystals bearing smooth | |
| M | 5.2 | grease | 1.1[e] | | 1,500 | 65–80 | 4,008 | white grease with some black powder, bearing slightly stiff | 4,840 |
| N | 8.3 | grease | 2.8[e] | | 4,200 | 450–760 | >6,000 | grease in good condition, bearing free and smooth | 4,860 |

[a]at minus 73° C.
[b]at 10 minutes
[c]at 60 minutes
[d]at 232° C.
[e]at 22 hrs at 204° C.

EVALUATIONS

1. Neopenyl esters

Examples A and B were both based on monopentaerythrityl esters and contained the best commercial antioxidant package known for this type of fluid. However, these greases both showed poor performance in the Thin Film Oxidation Test at 200° C. Example A gave acceptable low temperature starting torque at minus 54° C. but running torque increased unacceptably with time.

Examples C and D were based on dipentaerythrityl esters together with the best commercial additive package known for this type of fluid. These greases too showed poor performance in the Thin Film Oxidation Test at 200° C. In the IP.183/63 Evaporation Loss Test at 200° C. the weight loss given by Example D was very high and when using normal air was about five times greater than when using nitrogen gas. This showed the poor performance in the Thin Film Oxidation Test to be due to oxidation and not just to the volatility of the base fluid. Example C failed the requirements of the Low Temperature Torque Test at minus 54° C. In rig tests in bearings run under simulated condition, Example C ran for over 1,000 hours at 200° C. but after this time the condition of the grease was considered very poor.

Examples E and F were both based on a mixture of complex neopentyl esters together with the best available commercial antioxidant package for this type of fluid. They too showed poor performances in the Thin Film Oxidation Test at 200° C. They were not tested further.

In general, the results obtained in the greases based on neopentyl esters showed that those materials are unsuitable for use under the envisaged conditions.

2. Perfluoroalkyl polyethers

Example G was based on linear perfluoroalkyl polyethers as available in a range of materials called Fomblin fluids. This grease gave high weight losses at 200° C. in the Thin Film Oxidation Test and in the IP.183/63 Evaporation Test under both air flow and nitrogen flow.

In view of this high volatility, this type of grease cannot be considered for the present conditions. No further testing was carried out.

Example H was based on one of an alternative range of perfluoroalkylpolyethers, which appears to have a narrower boiling range than the Fomblin fluids, called Krytox fluids. This grease showed very good oxidation and thermal stabilities at 200° C. When tested in the IP.186/64 Low Temperature Torque Test, this grease failed to satisfy either of the requirements. However, in rig tests under simulated high temperature running conditions a very long lifetime, in excess of nine months at 200° C., was obtained. Because of the very poor low temperature torque properties, this grease was considered unsuitable for the present conditions.

3. Synthetic hydrocarbons

Example J was based on a synthetic hydrocarbon material with antioxidant package thickened with proofed silica in a typical synthetic grease formulation. This grease gave poor results in both the Thin Film Oxidation Test at 200° C. and the IP.183/63 Evaporation Loss Test so this type cannot be further considered for the present conditions. No further testing was carried out.

4. Silicone fluids

Example K was based on an inhibited silicone fluid material known to have excellent low temperature properties. In the Thin Film Oxidation Test this grease gave very low losses although the final condition of the residue was poor. Low Temperature Torque Test results were excellent but unfortunately in rig tests under simulated conditions the maximum life obtained was less than one month (630 hours). This type of grease was considered unsuitable for the present conditions.

5. Fluorosilicone fluids

Example L was a commercially available grease known to be based on a fluorosilicone fluid. This grease showed good performance in the Thin Film Oxidation Test at 200° C. and low weight loss in the IP.183/63 test. Volatility as measured by the method of IP.183/63 was higher than that considered suitable and in rig testing under simulated conditions a lifetime of less than two months was obtained (only 1,092 hours).

In view of the various failings observed with the greases listed previously, all based on prior art formulations, a novel formulation was produced based on the combination of a linear perfluoroalkyl polyether fluid of the type employed in the preparation of Example H above and a methylpolysiloxane fluid of the type employed in the preparation of Example K, together with a thickener. This grease was included as Example M and showed very good oxidation stability and low volatility together with excellent low temperature torque characteristics. When this grease was subjected to rig testing under simulated high temperature running conditions, a lifetime was obtained of six months (4,000 hours).

The linear perfluoroalkyl polyether fluid used in the preparation of the commercial grease employed as Example H is one of a series of similar materials. One source of such materials is the Krytox range of fluids sold by E. I. DuPont de Nemours and Co. (Inc.) and in particular their Krytox 143 fluids. These oils have average molecular weights ranging from 2,000 to 7,000.

For the present application, low volatility is considered of most importance. For that reason those oils reported to have the lowest volatilities, i.e., by ASTM method D 972 Mod., volatilities, as weight loss percentages after 6.5 hours at 400° F. (204.4° C.), of 6 or less are desirable.

The preferred fluids are Krytox 143 AC and Krytox 143 AD, reported as having volatilities in this test of 1, while also described as having the highest average molecular weights in the range. The fluid most preferred in the one currently advertised as Krytox 143 AC.

The methyl silicone fluid used in the preparation of the commercial grease employed as Example K was a methyl phenyl silicone fluid.

One source of such materials is the MS range of silicone fluids sold by Midland Silicones Limited, for example those fluids designated MS 510, MS 550 and MS 710. The MS 510 fluid is available in two viscosities, viz; 50 cS and 500 cS, measured at 25° C. For the present application the higher viscosity material (MS 510/500) was found to be the most suitable.

Although the components described above are limited to those materials having the general formulae indicated it is recognized that some substituted materials for example halogen substituted silicone fluids, based on these general formulae may also be useful. Such materials are considered to be within the scope of the present description.

Anti-rust Additive

Although the grease formulation according to the invention and exemplified by Example M meets all the requirements discussed above and this grease is therefore suitable for use under the conditions envisaged, evaluation of its anti-rust properties in the ASTM D 1743 Rust Test showed them to be poor. This means that although the grease is suitable for use in stainless steel bearings, it cannot be recommended for use in a wider range of applications with complete confidence. In order to improve the anti-rust properties of the grease, several additives were evaluated in the same anti-rust test in grease M. The results are shown in Table 2. Where considered appropriate, the starting and running torques in the IP 186/64 Low Temperature Torque Test were also determined and these too are included in the table.

TABLE 2

| Anti-rust additive added | Performance in ASTM D 1743 Rust Test | IP 186/64 Starting g.cm | IP 186/64 Running g.cm |
|---|---|---|---|
| None | Fail | 1530 | 80 |
| 5%m basic Ca Sulphonate | Fail | — | — |
| 5% m basic Ca alkyl salicylate | Pass | 5360 | 380 |
| 5%m Ba dinonyl naphthalene sulphonate | Pass | 8670 | 260 |
| 2.5%m oil-free basic Ca alkyl-salicylate | Pass | 3600 | 130 |
| 5%m oil-free basic Ca alkyl-salicylate | Pass | 4200 | 450 |
| 5% oil-free Ba dinonyl naphthalene sulfonate | Fail | 2900 | 150 |

From the above Table 2 it can be seen that two of the additives basic calcium alkyl salicylate and barium dinonyl naphthalene sulphonate proved successful in improving the anti-rust ability of the basic grease formulation sufficiently for it to meet the requirements of the ASTM D 1743 Test. However, when grease containing these two additives were evaluated for Low Temperature Torque by the method of IP 186 at minus 54° C., unacceptably high values were obtained. It was considered that these be caused by the presence of mineral oil diluent in the additive packages as obtained and further tests were made using additives freed of this diluent. The oil-free version of basic calcium alkyl salicylate was found to be particularly effective and the grease containing it passed the IP 186/64 Test.

It was envisaged that the basic oil-free additive can be incorporated at the usual additive concentration stage of between 0.1% m and 10% m. In particular, we employed 5% m of the additive in the example tested.

Base fluids suitable for use in the improved grease formulations of the present invention can be prepared from a range of combinations of perfluoroalkyl polyether fluids and methyl silicone fluids containing between 55% m and 95% m of the perfluoroalkyl polyether fluid together with between 45% m and 5% m of the methyl silicone fluid. Preferred combinations are between 75% m and 90% m of the perfluoroalkyl polyester fluid and between 25% m and 10% m of the methyl silicone fluid. The exact proportions used depends upon the actual components selected and their respective viscosities and average molecular weight.

The base fluids can be thickened to any required consistency using a suitable thickener. With the combination of Krytox 143 AC and MS 510/500 employed to prepare the examples discussed herein, we have found the most useful thickener to be polytetrafluoroethylene. A commercially available thickener of this description is Fluon L 170 supplied by I.C.I. In the above examples between 20% m and 30% m polytetrafluoroethylene were used.

What is claimed is:

1. A grease composition comprising a base fluid comprising a major amount of a low-volatility linear perfluoroalkyl polyether fluid together with a minor amount of a methyl polysilicone fluid, and a polytetrafluoroethylene thickener.

2. The composition of claim 1 wherein the perfluoroalkyl polyether has an average molecular weight range from 2,000 to 7,000.

3. The composition of claim 2 wherein the base fluid comprises between 75% m and 90% m of the linear perfluoroalkyl polyether fluid together with between 25% and 10% m of the methyl polysilicone fluid.

4. The composition of claim 3 wherein the polytetrafluoroethylene thickener is present in an amount between 20% m and 30% m.

5. The composition of claim 2 which comprises a minor amount of a highly basic mineral oil-free anti-rust additive.

6. The composition of claim 5 wherein the mineral oil-free additive is calcium alkyl salicylate.

7. The composition of claim 5 or claim 6 wherein the additive is present in an amount between 0.1% and 10% m.

8. The composition of claim 1 wherein the polysilicone fluid is a methyl phenyl silicone fluid.

9. The composition of claim 8 wherein the perfluoroalkyl polyether has an average molecular weight ranging from 2,000 to 7,000.

10. The composition of claim 9 wherein the base fluid comprises between 75% m and 90% m of the linear perfluoroalkyl polyether fluid together with between 25% and 10% m of the methyl phenyl silicone fluid.

11. The composition of claim 10 which comprises a minor amount of a highly basic mineral oil-free anti-rust additive.

12. The composition of claim 11 wherein the mineral oil-free additive is calcium alkyl salicylate.

13. The composition of claim 11 or claim 12 wherein the additive is present in an amount between 0.1% and 10% m.

* * * * *